US006853381B1

(12) United States Patent
Grigor et al.

(10) Patent No.: US 6,853,381 B1
(45) Date of Patent: Feb. 8, 2005

(54) METHOD AND APPARATUS FOR A WRITE BEHIND RASTER

(75) Inventors: Gordon Grigor, Toronto (CA); Indra Laksono, Richmond Hill (CA); James Doyle, Thornhill (CA); Kin Man William Yee, Quincy, MA (US); David L. J. Glen, Toronto (CA)

(73) Assignee: ATI International SRL, Hastings Christ Church (KN)

( * ) Notice: Subject to any disclaimer, the term of this patent is extended or adjusted under 35 U.S.C. 154(b) by 0 days.

(21) Appl. No.: 09/397,188

(22) Filed: Sep. 16, 1999

(51) Int. Cl.[7] ..... G09G 5/39
(52) U.S. Cl. ..... 345/531; 345/503; 345/545
(58) Field of Search ..... 345/501, 503, 345/520, 531, 534, 539, 545, 548, 568

(56) References Cited

U.S. PATENT DOCUMENTS 5,446,496 A * 8/1995 Foster et al. ..... 345/531
5,451,981 A * 9/1995 Drako et al. ..... 345/545
5,657,478 A * 8/1997 Recker et al. ..... 345/503
5,790,138 A * 8/1998 Hsu ..... 345/519
5,850,232 A * 12/1998 Engstrom et al. ..... 345/501
5,986,676 A * 11/1999 Dwin et al. ..... 345/501
6,054,980 A * 4/2000 Eglit ..... 345/204
6,091,432 A * 7/2000 Diehl et al. ..... 345/562
6,097,401 A * 8/2000 Owen et al. ..... 345/562
6,128,026 A * 10/2000 Brothers, III ..... 345/539
6,205,531 B1 * 3/2001 Hussain ..... 345/564
6,222,589 B1 * 4/2001 Faroudja et al. ..... 345/698

* cited by examiner

*Primary Examiner*—Ulka J. Chauhan
(74) *Attorney, Agent, or Firm*—Vedder, Price, Kaufman & Kammholz, PC

(57) ABSTRACT

In accordance with the present invention, a write behind controller receives control information from a display device controller in order to determine a current location available in a frame buffer for receiving information. Write accesses of the frame buffer by a rendering engine are prohibited if the access is to an area below a currently available location of the frame buffer. Generally, the rendering engine will be stalled when the requested address location has not yet displayed its data. Subsequently, the write access to the frame buffer is allowed when location has been rastered.

24 Claims, 7 Drawing Sheets

| | OUT0 | OUT1 | OUT2 |
|---|---|---|---|
| R=A | A | N | N |
| R=N | X | X | X |
| FR. COMP.=A | (OUT2) | (OUT2) | (OUT2) |
| FR. COMP.=N | (OUT2) | (OUT2) | (OUT2) |

METHOD AND APPARATUS FOR A WRITE BEHIND RASTER

FIELD OF THE INVENTION

The invention relates generally to processing digital information, and more particularly to the rendering of graphics data.

BACKGROUND OF THE INVENTION

Computers are known to include a central processing unit (CPU), memory, audio processing circuitry, video/graphics-processing circuitry, and peripheral interfaces such that the computer may interface with a keyboard, printer, mouse, etc. The memory may be in a variety of forms, such as a cache memory, hard drive, magnetic tape, floppy disk, random access memory (RAM), read only memory (ROM), compact disk read only memory (CD ROM), etc. Such memory temporarily, or permanently, stores programming instructions, which when read by a CPU cause the CPU to manipulate digital information based upon the programming instructions.

When instructions executed by the CPU require an update of displayed graphical information, rendering commands are issued from the CPU to a rendering engine. Generally, the rendering engine may or may not be a separate device or add-on board dedicated to rendering images on a displayed device. Generally, representations of images to be displayed upon a display device are first written into a frame buffer. The frame buffer will have a memory location associated with each pixel of the display device.

Systems that have a single frame buffer are referred to as being single buffered systems. Numerous problems exist with single buffered systems. For example, tearing of an image can occur through the use of a single buffered system. Tearing occurs when the rendering engine writes new image information into the frame buffer over frame buffer locations that contain data yet to be displayed from the previous image. In other words, during a single screen refresh cycle, portions of data from two frames of data will be displayed. The tearing produces non-contiguous images that are detectable by users.

One method of limiting tearing is to prevent any new data from being rendered into a frame buffer prior to the data within the frame buffered being displayed. However, this can result in choppy video/graphics because the next frame of video may not be available immediately because of the requirement that new data cannot be provided to the frame buffer until after the previous frame of data has been displayed.

Another prior art method used to overcome the disadvantages of single framed systems, is to have the system CPU, which provides the rendering operations to the rendering engine, poll the display device controller to determine which portion of the frame buffer has been rastered. Note the term rastered is used to indicate the portion of data in a frame buffer which has been displayed, or accessed for display, and therefor is no longer needed in the frame buffer. Once the system can be assured that the rendering operation about to be issued by the system contains data to be saved only above the current line of video/graphics being displayed, the rendering operation is dispatched to the rendering engine. However, such polling implementation has significant impact on rendering performance.

One reason the described polling operation impacts performance, is that a rendering operation waiting to be issued by the CPU can represent a primitive having only a small portion of its area below a fine current being rastered. However, in order to assure the primitive will not cause tearing, it is necessary to wait until the display engine indicates all locations of the frame buffer needed to store the primitive image have been rastered. In other words, where a large triangle is to be issued for rendering, and only a small portion of the triangle is below the line currently being rastered, the polling operation described will result in the display engine indicating the frame buffer is not ready. Therefore, the dispatch of the operation will be stalled even though the rendering engine could be doing useful work on most of the triangle.

In order to overcome the problems of single frame buffered systems, dual and triple frame buffered systems have been suggested. While multiple frame buffered systems, resolve most issues with tearing and choppy text, it is still possible for rendering engines to overwrite the current locations of multiple memories, or result in the stalling of CPUs waiting to issue rendering operations.

Therefore, a system capable of overcoming the identified problems of the prior art would be desirable.

DETAILED DESCRIPTION OF THE DRAWINGS

In accordance with the present invention, a write behind controller receives control information from a display device controller in order to determine a current location available in a frame buffer for receiving information. Write accesses of the frame buffer by a rendering engine are prohibited if the access is to an area below a currently rastered location of the frame buffer. Generally, the rendering engine will be stalled when the requested address location has not yet displayed its data. Subsequently, the write access to the frame buffer is allowed when location has been rastered.

Figure 1:
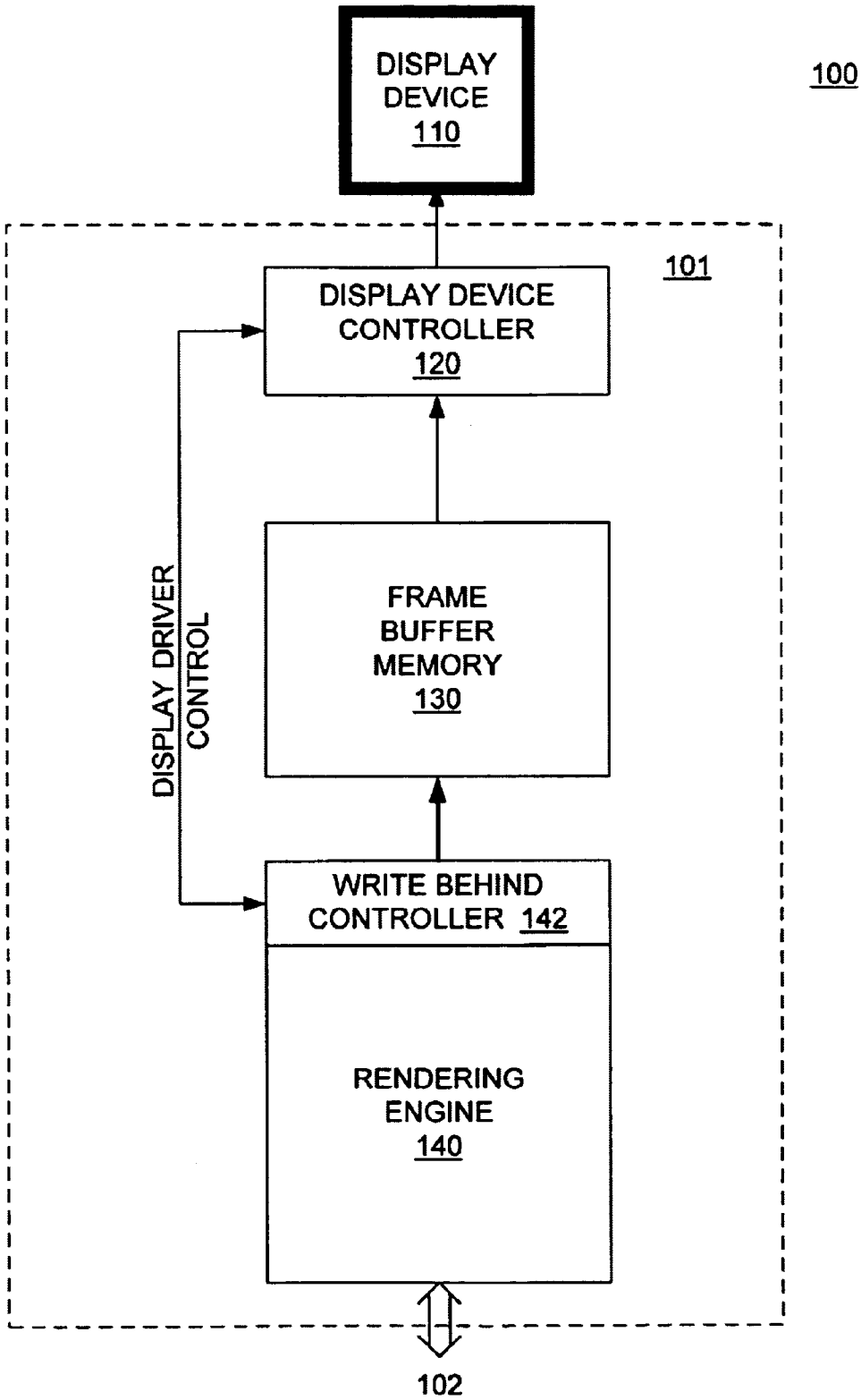
FIG. 1 illustrates, in block form, a system in accordance with the present invention.

The present invention is best understood with reference to the FIGS. 1–5. FIG. 1 illustrates a system 100, which includes a display device 110, and a video graphics adapter 101. In operation, the VGA 101 receives rendering commands from a system over a system bus 102. The rendering commands represent primitives to be drawn by the VGA 101. Primitives generally represent basic shapes, such as circles, squares, or triangles. By receiving and rendering a plurality of rendering commands, it is possible to draw complex graphics using primitives. Once the VGA 101 has rendered the received operations, the images they represent are displayed on the display device 110.

The display device 110 can represent a cathode ray tube (CRT) monitor, such as would be associated with desktop computer systems, video/graphic projection systems, optical goggles, liquid crystal displays (LCD's),'s), or any other type of display device.

The VGA 101 includes a display device controller 120, a frame buffer memory 130, and a rendering engine 140. In normal operation, the rendering engine 140 receives rendering commands over a system bus, and performs the calculations necessary to provide a representation of the command's image to the frame buffer memory 130. Typical operations performed by rendering engine 140 include adding color, shading, texture, light source information, and viewing information for each affected pixel. In a specific embodiment of the present invention, a write behind controller 142 is included as part of the rendering engine 140. Instead of the rendering engine 140 being able to write the rendered data immediately to the frame buffer memory 130, the write is qualified by the write behind controller 142. In other words, the write behind controller 142 can prevent the rendering engine 140 from writing into the frame buffer memory 130.

The availability of a memory location within the frame buffer memory 130 is dependant upon whether or not display device controller 120 has retrieved previously rendered data from the memory location. A frame buffer location is available, and can be over-written with new information from the rendering engine 140 once the display device controller 120 retrieves the data previously stored at the location of the frame buffer. The write behind controller 142 receives display device control information from the display device controller 120 in order to determine which locations within the frame buffer memory 130 are available.

The specific embodiment of FIG. 1 is advantageous over the prior art, in that it allows a hardware implementation to control whether or not the rendering engine 140 can write into a specific memory location. Unlike the prior art, which made the determination at the system level based on worst case scenarios. In accordance with the present invention, it is possible for a primitive, which when received by the rendering engine may not be able to be written in its entirety into the frame buffer, to be processed by the rendering engine and written into available locations of the frame buffer without the system having to be concerned whether a sent rendering command can be currently displayed.

Being able to write a frame buffer in this manner allows the frame buffer to be utilized more efficiently. As a result, where a single frame buffer is used, the use of the write behind controller 142 allows for the system to act as though it has nearly two frame buffers; where two frame buffers are available within the frame buffer memory 130, the system will act as though nearly three frame buffers are available.

FIG. 1 illustrates a specific embodiment of the present invention. It should be understood that other embodiments can also be implemented. For example, the write behind controller 142 may reside within the rendering engine 140, separate from the rendering engine 140, or possibly even within the display device controller 120. In addition, the frame buffer memory 130 is illustrated as being incorporated as part of the video graphics adapter 101, when in actuality, the frame buffer memory could reside separate from the video graphics adapter. For example, an add-in slot can be used in order to support the frame buffer memory 130. In another embodiment, the frame buffer memory 130 can reside in a system memory (not shown), and accessed over the system bus 102, such as a PCI (Peripheral Components Interface) bus, or an AGP (Advanced Graphics Port) bus.

Figure 2:
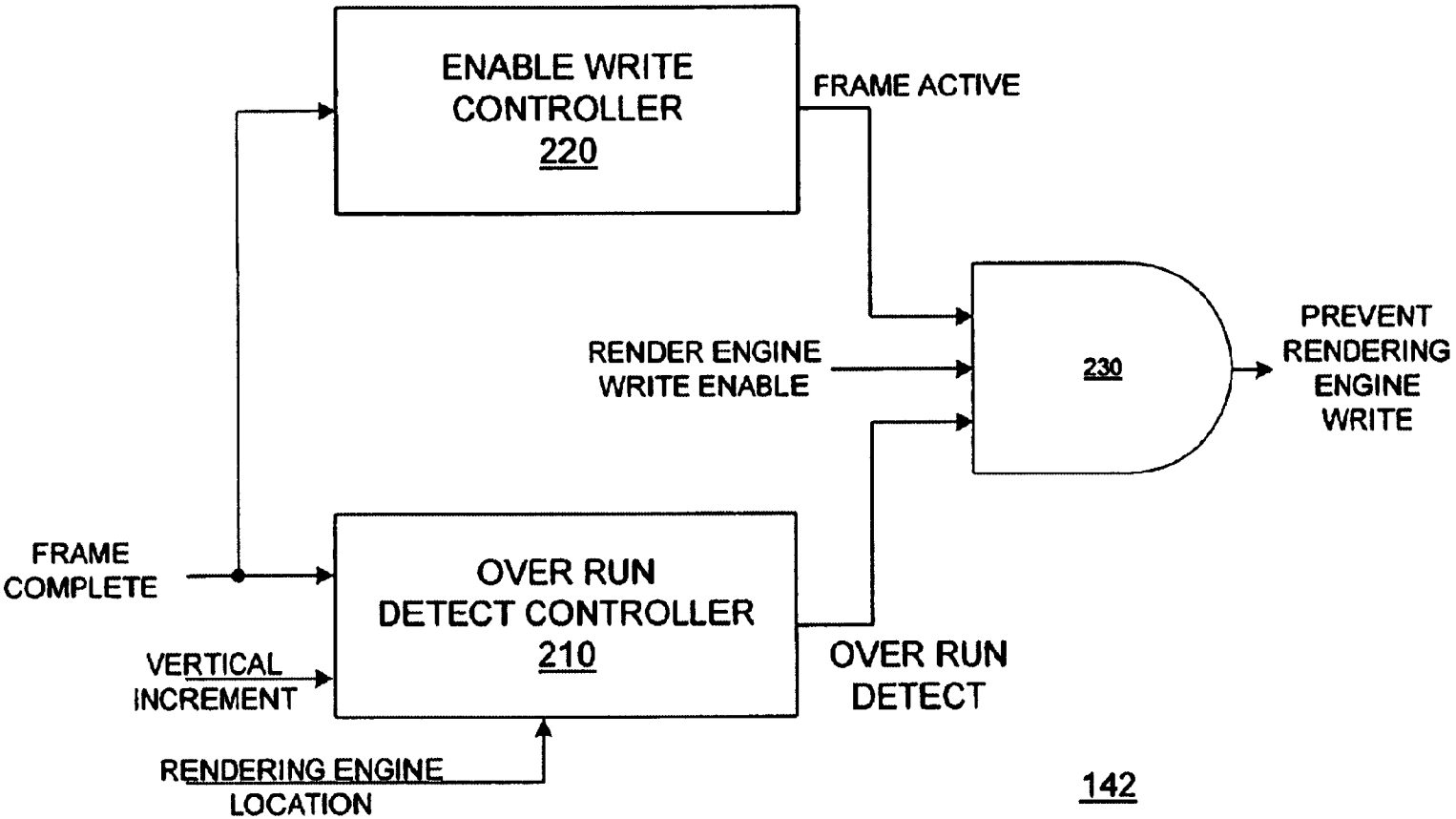
FIG. 2 illustrates, in block and logic form, a portion of the system of FIG. 1 in greater detail.

FIG. 2 illustrates a specific implementation of the write behind controller 142 of FIG. 1. The specific implementation of FIG. 2 includes an enable write controller 220, an overrun detect controller 210, and an AND gate 230. The overrun detect controller 210 receives a signal, or indicator, labeled FRAME COMPLETE from the display device controller 120 of FIG. 1, a signal labeled VERTICAL INCREMENT from the display device controller 120, and a signal labeled RENDERING LOCATION from the rendering engine.

Based upon the FRAME COMPLETE and the VERTICAL INCREMENT signals, the overrun detect controller 210 is able to monitor whether the address offset within a frame buffer accessed by the display device controller 120 is potentially in conflict with the rendering engine data being written. In other words, the overrun detect controller 210 determines whether or not the rendering engine 140 is ahead of the display device controller. In the embodiment illustrated, this is accomplished by comparing the display device controller 120 location with the RENDERING ENGINE LOCATION signal. The output from the overrun detect controller 210 is labeled OVERRUN DETECT, and indicates a potential overrun situation. Note that in the specific embodiment of FIG. 2, the overrun detect controller 210 monitors the offset location with a specific frame. In other words, the OVERRUN DETECT signal only indicates that the offset location of the display device controller and the rendering engine 140 match, not that they are accessing the same frame buffer. In other words, where the frame buffer memory 130 can represent one or more separate frame buffers. The over run detect controller only monitors offsets regardless of the frame buffer being accessed.

The enable write controller 220 provides a signal labeled FRAME ACTIVE. The FRAME ACTIVE signal indicates when the rendering engine 140, and the display device controller 120, are accessing a common frame buffer within the frame buffer memory 130. When the display device controller 120, and the rendering engine 140 are accessing the same frame buffer within the frame buffer memory 130, the potential for overwriting data exists, and therefore the FRAME ACTIVE signal is active. An asserted FRAME ACTIVE signal indicates to the write behind controller 142 to prevent the data from being overwritten.

The FRAME ACTIVE signal, and the OVERRUN DETECT signal are received by an AND gate 230. In addition, a signal labeled RENDER ENGINE WRITE ENABLE signal is received by the AND gate 230. The RENDER ENGINE WRITE ENABLE signal is generally a register bit for controlling whether or not the write behind raster feature is to be utilized. When each of the signals received by the AND gate 230 are active, a signal labeled PREVENT RENDERING ENGINE WRITE is generated.

An asserted PREVENT RENDERING ENGINE WRITE can be used in a number of manners. It can be used to stall the rendering engine to prevent a write request signal from being provided to the frame buffer memory, or to prevent an acknowledge signal from be received by the rendering engine 140. Regardless of the specific implementation, when the PREVENT RENDERING ENGINE WRITE signal is asserted, the current rendering engine data will not be written from the rendered engine 140 to the frame buffer memory 130, until the over run situation is resolved.

Subsequent to the PREVENT RENDERING ENGINE WRITE signal being asserted, additional lines of video can be accessed by the display device controller. Subsequent accesses will result in the VERTICAL INCREMENT signal being asserted indicating the updated locations available in memory. When the memory conflict no longer occurs between the display device controller and the rendering engine, the PREVENT RENDERING ENGINE WRITE signal is disabled, thereby allowing the previously requested write to proceed.

Figure 3:
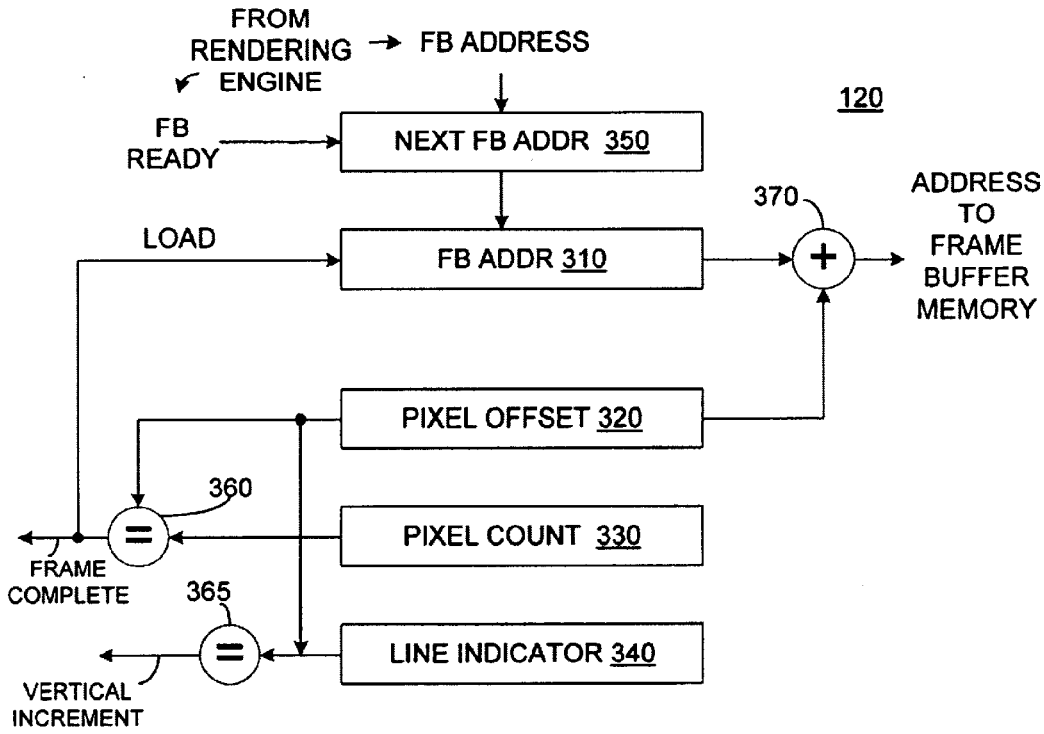
FIG. 3 illustrates, in block form, a portion of the system of FIG. 1 in a greater detail.

FIG. 3 illustrates a specific implementation of the display device controller 120 of FIG. 1. The display device controller 120 has a register 310 for storing a frame buffer address. The frame buffer address indicates which frame buffer in a multi-frame buffer system is currently being utilized. Generally, the frame buffer is indicated by storing the starting address of the frame buffer. In the event where a single frame buffer is utilized by the system, the frame buffer address will not change, and therefore may be omitted.

Adding the value stored in the register FB ADDR 310 to the pixel offset stored within a register 320, provides an address value to access data within the current frame buffer. The pixel offset indicates a current pixel or location being accessed within the current frame buffer. One skilled in the art will recognize that the value associated with the PIXEL OFFSET register 320 can be derived from the vertical and horizontal display offsets from the display controller. In addition, the value stored in register 320 may be updated pixel by pixel, or on a line by line basis.

The PIXEL OFFSET 320 and FB ADDRESS 310 values are added together using an adder 370. The adder 370 result provides the value of the address location being rastered. An increment signal received by the register 320, causes the pixel offset value to be incremented by an appropriate amount. For example if 3 bytes represent a single pixel, the pixel offset would be incremented by 3. Where the increment indicates an entire line of video has been accessed the increment will cause the register to be incremented by the number of pixels associated with a line of data.

A register 350 labeled NEXT FB ADDR receives signals labeled FB ADDRESS, which indicates the location of the next frame buffer, and FB READY, which is used to load in the location into the register 310. Generally, the next frame buffer address is specified by the rendering engine 140. In systems with multiple frame buffers, the next frame buffer address indicates the next frame buffer to be displayed.

In a specific embodiment, when the PIXEL OFFSET register 320 contains a value that matches a total pixel count value stored in register PIXEL COUNT 330, the signal labeled FRAME COMPLETE is generated by comparator 360 indicating that the current frame has been completely displayed, and a new frame buffer is to be used. The FRAME COMPLETE signal provides a signal, such a pulse, each time a new frame buffer is to be used. The FRAME COMPLETE signal is used to load the value of the next frame buffer from register 350 into the current frame buffer register 310. In addition, the FRAME COMPLETE signal is provided to the write behind controller 142.

A comparator 365 monitors at least a portion of the value stored within the pixel offset register 320 and compares it to a line indicator value stored within the register LINE INDICATOR 340. When a match occurs, an indicator labeled VERTICAL INCREMENT is provided indicating a new line has been accessed. In a specific embodiment, the VERTICAL INCREMENT indicator will be a pulse indicating when a new line is being read from the frame buffer memory 130 and provided to the display. By providing an indication as to when a new frame buffer line has been accessed, it is possible to monitor the location of the display device controller 120, from the write behind controller 142.

Figure 4:
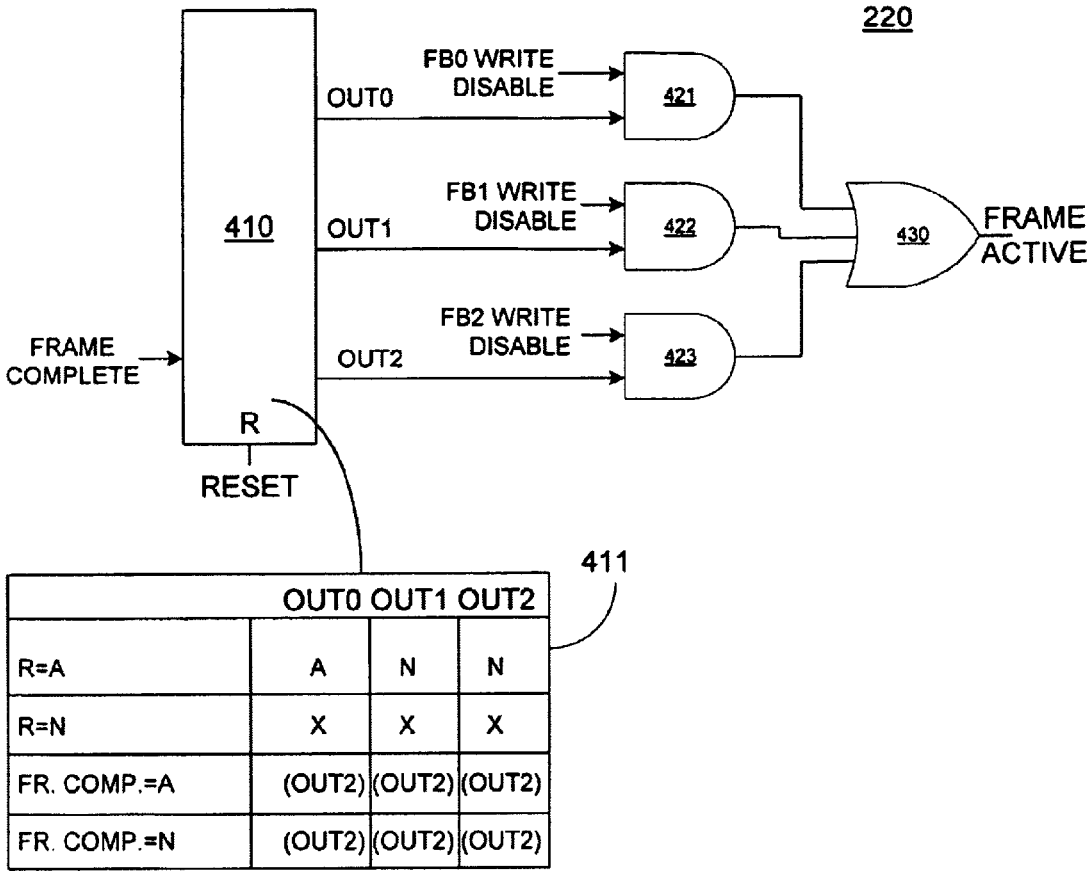
FIG. 4 illustrates, in block and logic form, a portion of FIG. 2 in greater detail.

FIG. 4 illustrates a specific embodiment of the disable write controller 220 of FIG. 2. As illustrated in FIG. 4, the disable write controller 220 includes a circular shift register 410. The logic table 411 illustrates the functionality of the circular shift register 410. Specifically, when an asserted reset signal is received, the signal labeled OUT0 is asserted, while the signals OUT1 and OUT2 are de-asserted. An asserted output signal indicates that the frame buffer associated with the asserted signal is currently being accessed by the display device controller 120.

For the specific implementation of FIG. 4, it is assumed that three frame buffers are included in the frame buffer memory 130. During reset, the frame buffer associated with the signal OUT1 of the circular shift register is inactive, as is the frame buffer associated with the signal OUT2. Each time that the display device controller 120 accesses a new frame buffer, the FRAME COMPLETE signal is asserted as discussed previously. Each time the FRAME COMPLETE signal is asserted, the output values are advanced. In other words, following a reset, the first asserted FRAME COMPLETE signal to the circular shift register 410 will result in the signal OUT1 being asserted, while signals OUT0 and OUT2 are de-asserted. In this manner, it is possible to monitor which of the frame buffers is the frame buffer currently being accessed by the display device controller.

One of ordinary skill in the art will recognize that many different implementations for keeping track of which frame buffer is being used are possible. For example, it would be possible to monitor the specific addresses being accessed by the display device controller 120 and the rendering engine 140, by comparing them to known addresses. In other implementations arithmetic logic units can be used in order to perform this function in software.

The signal OUT0 is received by an AND gate 421. The AND gate 421 also receives an input signal labeled FB0 WRITE DISABLE. FB0 WRITE DISABLE is asserted when the rendering engine 140 is currently writing data to the first frame buffer (FB0). If the signals FB0 WRITE DISABLE and OUT0 are both asserted, it indicates that both the rendering engine 140, and the displayed device controller 120 are attempting to access data within the first frame buffer (FB0). As a result, it is necessary to signal the write behind controller 140 to prevent the rendering engine from overwriting data in FB) that is yet to be accessed for display.

The second frame buffer (FB1) and the third frame buffer (FB2) are protected in a similar manner as the first frame buffer (FB0). The output signals of the respective AND gates 421, 422, and 423 are received by an OR gate 430. If any one of the frame buffers FB0–FB2 are being accessed simultaneously by both the rendering engine 140 and the display device controller 120 the FRAME ACTIVE signal will be asserted by the OR gate 430.

Referring to FIG. 2, the FRAME ACTIVE signal from the disable write controller 220 is received by the AND gate 230. Therefore, when RENDERING ENGINE WRITE DISABLE, OVERRUN DETECT, and the FRAME ACTIVE signal are all asserted, the PREVENT RENDERING ENGINE WRITE signal is also asserted.

Other implementations of the write behind controller are possible. For example, the address of the frame buffer memory 130 location being accessed by the display device controller 120 can be directly compared to the address of the frame buffer memory 130 location being accessed by the rendering engine 140. When the comparison indicates that the rendering engine is accessing memory greater than or equal to the that being accessed by the display device controller, a determination can be made to prevent and/or delay the rendering engine access. Such an implementation would require knowledge as to where in the frame buffer memory the frame buffer is stored, so that writes to a frame buffer other than the one currently being displayed will not be prevented.

Figure 5:
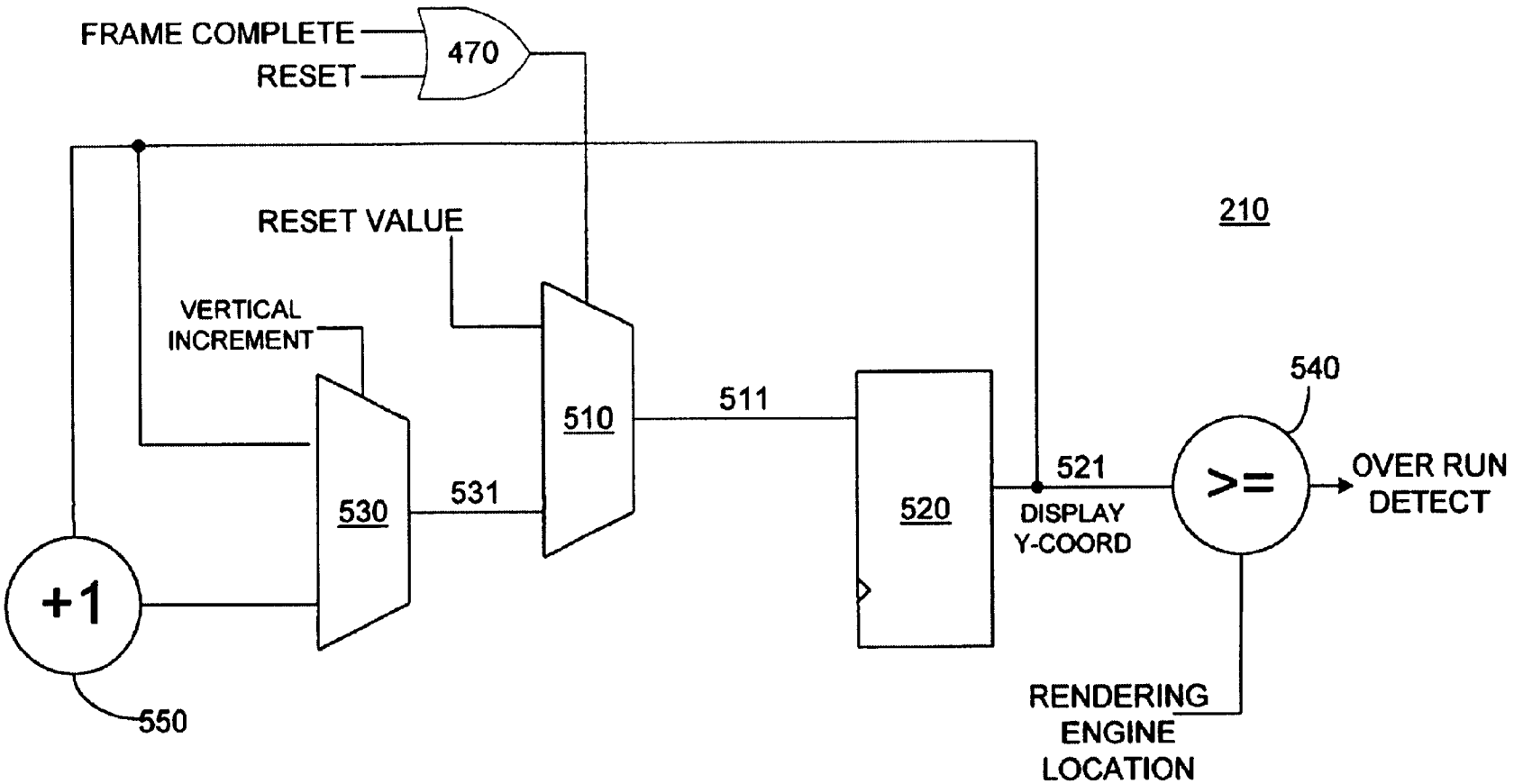
FIG. 5 illustrates, in block and logic form, a portion of FIG. 2 in greater detail.

FIG. 5 illustrates a specific implementation of the overrun detect controller 210 of FIG. 2. During a reset operation, or whenever a new frame is being accessed, A RESET VALUE is received by multiplexor 510 resulting in a RESET VALUE being provided to the node 511. Note that the nodes of FIG. 5, including node 511 may actually comprise a plurality of nodes or a bus. The RESET VALUE provided to node 511 is latched into the node 521 by latch 520. The output of the latch 520 is labeled DISPLAY Y-COORD, which is indicative of the of data being displayed, or accessed, by the display device controller 120.

For example, during reset, or when a new frame is accessed by the display device controller 120, the DISPLAY Y-COORD signal will generally be equal to zero, or one, in order to indicate the first line of the frame is being displayed. As the display device controller 120 displays subsequent lines of data, the VERTICAL INCREMENT indicator will be asserted and received by the multiplexor 530. When received by the multiplexor 530, the DISPLAY Y-COORD value will be incremented by the incrimentor 550, and the incremented value provided onto the node 531 by multiplexor 530. When the VERTICAL INCREMENT signal is not active, the multiplexor 530 acts to further latch the data by providing closed loop feedback to the multiplexor 510. By resetting the value on node 511 during reset, and during vertical refreshes cycles performed by the display device controller, it is possible to maintain a current DISPLAY Y-COORD value at the node 521.

The Display Y-COORD value at node 521 is compared to a RENDERING ENGINE LOCATION signal. Generally, the RENDERING ENGINE LOCATION represents the graphical user interface Y-coordinate being used by the rendering engine 140. The RENDERING ENGINE LOCATION generally is the offset location within the current frame buffer where the rendering engine is attempting to write. If the DISPLAY Y-COORD, and the RENDERING ENGINE LOCATION are the same or the RENDERING ENGINE LOCATION value is greater than the DISPLAY Y-COORD value, or meet some other predefined criteria is met indicating a conflict, the rendering engine 140 is going to access data within the frame buffer memory 130 having the same frame buffer offset. Provided both the rendering engine 140 and the display device controller are accessing the same frame buffer there will be a conflict. Therefore, an asserted OVERRUN DETECT signal is provided by the circuit of FIG. 5 to the comparitor 540.

It should be understood that other specific embodiments of the overrun detect controller 210 can be used. For example, the comparitor 540 can actually be a greater than or equal to comparitor, whereby any RENDERING ENGINE LOCATION that is greater than or equal to the DISPLAY Y-COORD value results in an asserted OVER RUN DETECT.

Referring to FIG. 2, it should now be apparent that when an asserted Frame Active signal is provided to the AND gate 230, the RENDER ENGINE WRITE ENABLE signal is asserted, and an OVERRUN DETECT signal is ASSERTED, that a situation has occurred where the rendering engine 140 is about to write information into the frame buffer at a location where data yet to be displayed is being stored. Therefore, the PREVENT RENDERING ENGINE WRITE signal of FIG. 2 is asserted by the write behind controller 142 to prevent a write to a frame buffer.

It should be understood, that the system described with reference to FIGS. 1–5 is advantageous over the prior art in that it allows a rendering commands to be provided to the VGA 101 without the issuing system having to determine if a write to the frame buffer memory 130 is possible. The hardware solution illustrated prevents overwriting useful frame buffer information by preventing writes until no conflict will occur. At the same time, the reception of rendering commands by the rendering engine is not prohibited based upon frame buffer activity.

Figure 6:
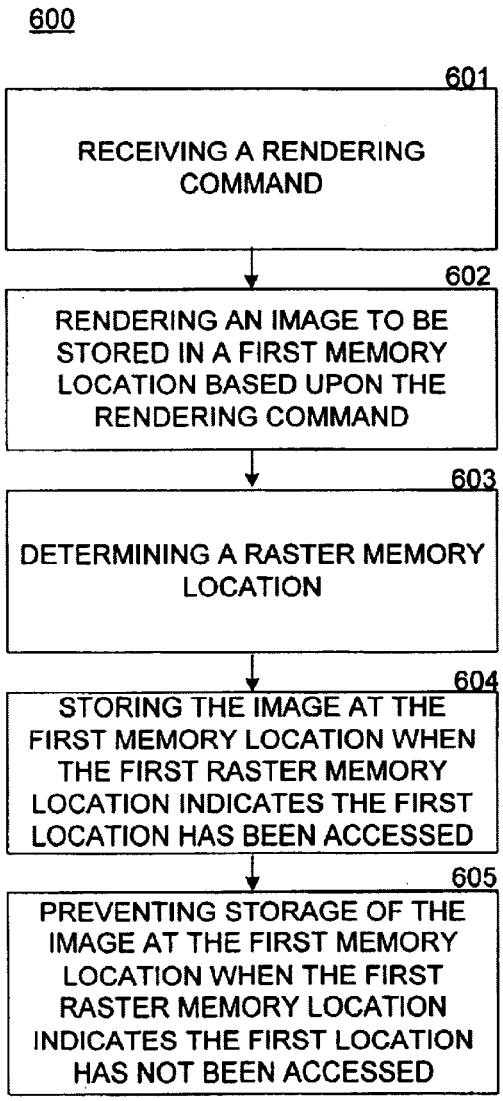
FIG. 6 illustrates, in flow diagram form, a method in accordance with the present invention.

FIG. 6 illustrates a method 600 in accordance with the present invention. At step 601 a rendering command is received by a graphics processor. Generally, a system processor will provide the rendering command. However, any processing device requesting a specific primitive, or shape, to be drawn on a display device can provide the rendering command.

At step 602, an image is rendered based upon the rendering command. The term "rendered" refers to expanding a specific request (rendering command) identifying a primitive, such as a triangle, into all of the graphics data necessary to display the primitive on a display device. For example, a primitive representing a triangle may contain the three vertices, color, and shading information. The vertices, color, and shading information is received by graphics processor, which includes a rendering engine, and expanded into the individual pixel data that is stored in a frame buffer memory to ultimately display the primitive image on a display device. As each pixel, or portion, of the rendering operation is completed, it is stored within the frame buffer memory. Individual pixels are generally stored in one or more bytes. Individual display lines comprise a plurality of pixels. A specific frame buffer can be used to represent only specific portions of a frame.

At step 603, a second memory location, representative of a raster location is determined. The term "raster location" is indicative of data that is being drawn or to be drawn by the display device 110. The term can refer to the location in a frame buffer that has been accessed for display onto the display device 110, or, in another embodiment, the term can imply a specific location within the frame buffer memory 130 that is about to be accessed for display by the display device controller 120. The term raster location can also imply the frame buffer data location currently being displayed on the display device 110. In other words, the term raster location is indicative of a recently accessed frame buffer location to the frame buffer data that is to be displayed, or currently being displayed on the monitor 110.

At step 604, the storage of an image at a first memory location is enabled when the second memory location indicates that the raster has already accessed data from this first memory location. This is consistent with the discussion with reference to the FIGS. 1–5. Specifically, if the display device controller 120 has already accessed the frame buffer location being written to by the rendering engine 140, the write behind controller 142 will allow the write to be enabled.

At step 605, a portion of the image is prevented from being stored at a first memory location when the second memory location indicates the raster has not yet accessed data currently stored at the first memory location. In other words, the location of the frame buffer being accessed by the rendered engine 140 contains data yet to be displayed by the display device controller 120. Therefore, the rendering engine 140 will not be allowed to write to that location until a data has been accessed by the display device controller. Once the display device controller has accessed the first memory location, the portion of the image is stored.

Figure 7:
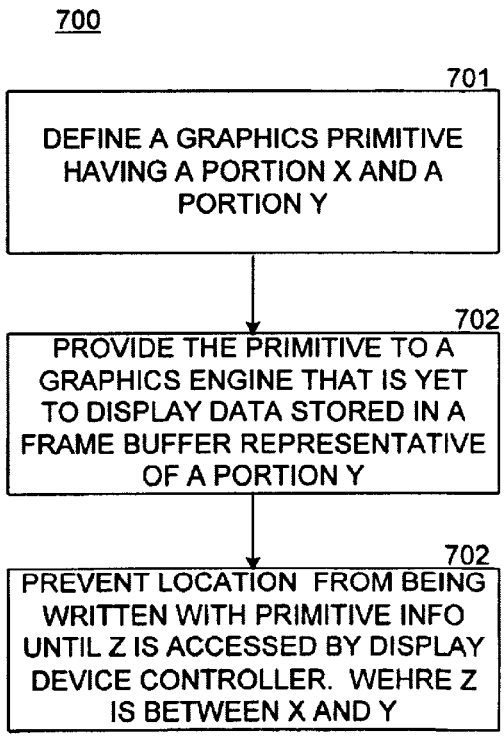
FIG. 7 illustrates, in flow diagram form, a method in accordance with the present invention.

FIG. 7 illustrates another method in accordance with the present invention. At step 701, a graphics primitive is defined having a first portion at a location X, and a second portion at a location y. The locations X and Y are indicative of locations representing the primitive. For example, X could be a physical, or a logical address location, or X and Y could be indicative of display lines at which the portion is to be displayed. For example, the location X can represent a primitive portion to be displayed at line 10 on a display device, while the second location Y is a different primitive portion to be displayed at line 30 of the display device. For example, a triangle can reside between line 10 and line 30.

At step 702, the graphics primitive information is provided to a rendering engine. The rendering engine defines the individual pixels associated with the primitive and stores the pixels in a frame buffer. The frame buffer is then accessed by the raster, which displays the individual pixels of data on the display device. At step 702, the raster has not yet accessed a location Z where Z is indicative of an address location between X and Y. For example, where X and Y represent line numbers associated with the display device, Z would be a line between line X, and line Y. Next, at step 703, the method 700 prevents the location Z from being overwritten with current graphics primitive data prior to the location Z having been accessed by the display.

Figure 8:
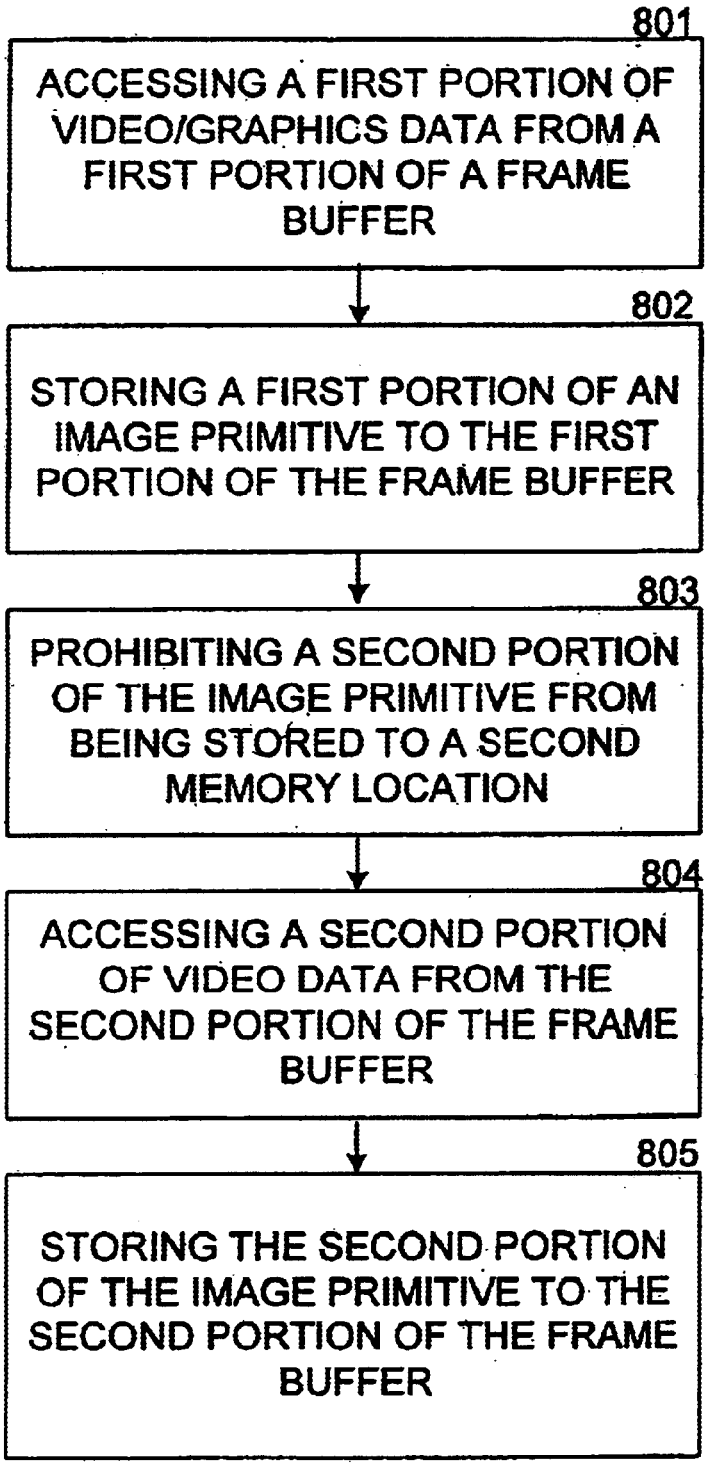
FIG. 8 illustrates, in flow diagram form, a method in accordance with the present invention.

FIG. 8 illustrates yet another method in accordance with the present invention. At step 801, a first portion of video/graphics data is accessed from a first portion of a frame buffer to be displayed on a display device. Generally, a display device controller performs such an access.

At step 802, a first portion of an image primitive is stored to the first portion of the frame buffer after the step of displaying as described in step 801. In other words, at step 802, a portion of a new image primitive is written to the location, which was accessed at step 801.

Next, at step 803, a second portion of the image primitive is prohibited from being stored at a second portion of the frame buffer adjacent to the first portion 802. This write is prohibited because the display device controller had accessed the first portion of the frame buffer, but is yet to access the second portion of the frame buffer that is adjacent to the first portion. Therefore, the write was enabled to the first portion, but a write to the second portion is prohibited at step 803 in order to prevent data from being destroyed before it is displayed. For example, a display line 20 may have been displayed, while display line 21 is yet to be fully displayed by the display device controller.

At step 804, the second portion of video/graphics data is accessed from a second portion of the frame buffer for display on the display device after the step of prohibiting at 803. In other words, at step 803, a write to the frame buffer was prohibited because the data had not yet been accessed. At step 804, the data currently stored in the frame buffer is accessed for display.

Subsequently, at step 805, the second portion of the image primitive is stored to a second portion of the frame buffer. The method of FIG. 8 illustrates the advantage over the prior art, in that writes can be delayed to protected areas of memory where a display device controller is yet to access useful data.

By now it should be apparent to one of ordinary skill in the art, that the present invention provides for a useful method and apparatus allowing for an efficient way to receive primitives to be displayed, while assuring data integrity of the frame buffer. The present invention has the advantage of utilizing frame buffer memory more efficiently.

It will be appreciated by one of ordinary skill in the art, that other embodiments and features of the present invention can be implemented. For example, where the VGA may prevent the system from issuing additional rendering commands if the VGA is waiting for frame buffer memory access. In addition, other implementations of the various features herein are possible.

We claim:

1. A method for providing image data:

receiving a rendering command;

rendering an image based upon the rendering command, wherein the image is to be stored at a first memory location of a single frame buffer;

determining a second memory location representative of a raster location;

enabling, by a write behind controller in a video graphics adapter, storage of the image at the first memory location when the second memory location indicates the raster has accessed data at the first memory location; and preventing, by the write behind controller, storage of the image at the first memory location when the second memory location indicates the raster has not accessed data at the first memory location.

2. The method of claim 1, wherein the step of receiving a rendering command, includes receiving a rendering command from a system processor.

3. The method of claim 1, wherein the first memory location and the second memory location are representative of a specific bytes of data.

4. The method of claim 1, wherein the fist memory location and the second memory location are representative of a unique groups of data.

5. The method of claim 4, wherein the unique groups of data includes data to be displayed as at least a portion of a line of video/graphics.

6. The method of claim 1, wherein the second memory location indicates a data accessed by a display device controller.

7. The method of claim 1, wherein the second memory location indicates a data to be accessed by a display device controller.

8. A method of providing image data:

defining a graphics primitive having a first portion at X and a second portion at Y, wherein X and Y are indicative of address locations;

providing the graphics primitive to a rendering engine when the rendering engine is storing data to a single frame buffer being accessed by a display device controller providing a current image, where the display device controller is yet to access an address location Z having data associated with the current image and the location Z is between X and Y; and preventing tearing of the current image.

9. The method of claim 8 wherein the address locations include display line numbers.

10. The method of claim 9 wherein the address locations include one of physical and logical address locations.

11. A method of providing image data:

accessing a first portion of video/graphics data from a first portion of a single frame buffer for display on a display device;

storing a first portion of an image primitive to the first portion of the single frame buffer after the step of displaying the first portion of video/graphics data; and prohibiting, by a write behind controller in a video graphics adapter, a second portion of the image primitive from being stored to a second portion of the single frame buffer after the step of storing the first portion, wherein the second portion of the single frame buffer is adjacent to the first portion of the single frame buffer.

12. The method of claim 11, further comprising the steps of:

accessing a second portion of video/graphics data from the second portion of the single frame buffer for display on the display device after the step of prohibiting; and storing the second portion of the image primitive to the second portion of the single frame buffer after the step of accessing the second portion of video/graphics data.

13. A system for storing video/graphics data, the system comprising:

a rendering engine to render images; and a write behind raster controller in a video graphics adapter coupled to the rendering engine to prohibit write access to memory locations in a single frame buffer that have not been displayed.

14. The system of claim 13 further comprising:

a display device controller coupled to the write behind raster to indicate a raster location.

15. The system of claim 13, wherein the rendering engine further includes:

a rendering engine location register, wherein the rendering engine location register is to store a first memory location to be accessed by the rendering engine; and an over-run detect portion coupled to the rendering engine location register, and coupled to receive a raster location indicator, and to provide an over-run detect indicator, wherein the rate location indicator indicates a second memory location relative to a location currently accessed by the rendering engine, and the over-run detect indicator to prohibit the rendering engine from write accessing to memory locations.

16. The system of claim 13, wherein the write behind raster includes:

a multiplexor having a first input, a second input, and an output;

a latch having an input coupled to the output of the multiplexor, and an output;

a comparator having a first input coupled to the output of the latch, a second input, and an output; and an incrementor having a first input coupled to the output of the latch, and an output coupled to the first input of the multiplexor.

17. A system for storing video/graphics data, the system comprising:

a rendering engine for rendering a primitive image and writing data representing the primitive image into a single frame buffer;

a display device controller for reading data from the single frame buffer for display; and a write prohibit means coupled to the display device controller to receive an indication of data read by the display device controller, and coupled to the rendering device to prevent a first portion of the primitive image from being written to the frame engine, while allowing a second portion of the primitive image to be written to the single frame buffer.

18. The system of claim 17, wherein the first portion is prevented from being written by stalling the rendering device.

19. The system of claim 17, wherein the write prohibit means further allows the first portion of the primitive image to be written to the single frame buffer based on an updated status of the indication of data read by the display device.

20. The system of claim 17, wherein the indication of data read indicates the access status of a line of video/graphics data.

21. A method of providing image data:

accessing a first portion of video/graphics data from a first portion of a single frame buffer for display on a display device;

storing a first portion of an image primitive to the first portion of the single frame buffer in response to accessing the first portion of video/graphics data for display; and prohibiting, by a write behind controller in a video graphics adapter, a second portion of the image primitive from being stored to a second portion of the single frame buffer in response to storing the first portion of the image primitive and until the first portion of the image primitive is displayed, wherein the second portion of the single frame buffer is adjacent to the first portion of the single frame buffer.

22. The method of claim 21, further comprising the steps of:

accessing a second portion of video/graphics data from the second portion of the single frame buffer for display on the display device after the step of prohibiting; and storing the second portion of the image primitive to the second portion of the single frame buffer after the step of accessing the second portion of video/graphics data.

23. A system for storing video/graphics data, the system comprising:

a rendering engine to render images to a plurality of memory locations in a single frame buffer; and a write behind raster controller in a video graphics adapter coupled to the rendering engine to prohibit write access to the plurality of memory locations in a single frame buffer when at least one of the memory locations has not been displayed.

24. The system of claim 23 further comprising:

a display device controller coupled to the write behind raster to indicate a raster location.

* * * * *